United States Patent [19]

Vitelli et al.

[11] 4,242,153

[45] Dec. 30, 1980

[54] METHODS FOR HOT ROLLING AND TREATING ROD

[75] Inventors: Vito J. Vitelli, Shrewsbury; Asjed A. Jalil, Holden; Norman A. Wilson, Shrewsbury, all of Mass.

[73] Assignee: Morgan Construction Company, Worcester, Mass.

[21] Appl. No.: 951,379

[22] Filed: Oct. 16, 1978

[51] Int. Cl.[3] ..... C21D 7/14

[52] U.S. Cl. ..... 148/12 B; 148/12.4; 148/156; 29/33 F; 29/DIG. 32; 29/DIG. 39; 266/103; 266/106; 266/113; 266/259

[58] Field of Search ..... 148/12 B, 12.4, 12.1, 148/156; 266/106, 109, 1 B, 103, 119, 142, 251, 259; 29/DIG. 39, DIG. 32, 33 F; 140/1, 2; 242/79, 82

[56] References Cited

U.S. PATENT DOCUMENTS

| | | | |
|---|---|---|---|
| 3,231,432 | 1/1966 | McLean et al. | 148/153 X |
| 3,389,021 | 6/1968 | Easter et al. | 148/12 B |
| 3,490,500 | 1/1970 | Dopper et al. | 140/1 |
| 3,645,805 | 2/1972 | Hoffmann et al. | 148/12.1 X |
| 3,711,338 | 1/1973 | Vitelli | 148/12.4 X |
| 3,926,689 | 12/1975 | Respen et al. | 148/12.4 |
| 3,940,967 | 3/1976 | Vitelli | 140/2 X |
| 4,108,695 | 8/1978 | Paulitsch et al. | 148/39 |

FOREIGN PATENT DOCUMENTS

| | | | |
|---|---|---|---|
| 1279605 | 10/1968 | Fed. Rep. of Germany | 140/2 |

*Primary Examiner*—Arthur C. Prescott

[57] ABSTRACT

Apparatus and methods for hot rolling and treating rod first by depositing the rod in spread-out ring form on a moving conveyor, then gathering it into a relatively loose somewhat offset bundle and thereafter subjecting it to batch treatments among which are conventional annealing, and/or coating and baking as well as new forms of annealing not heretofor practiced.

4 Claims, 11 Drawing Figures

METHODS FOR HOT ROLLING AND TREATING ROD

BACKGROUND OF THE INVENTION

This invention relates to hot rolling and treating rod products. Particular emphasis is placed on plain carbon and alloy steel rod, and a method and apparatus for the treatment thereof after hot rolling to provide a wide choice of physical properties for the rod at far less expense than by conventional rolling and heat treating processes. Also involved is hot rolling steel rod (as well as other rods) followed directly by batch type operations including coating, baking and/or heat treating.

The normal practice in the production of steel rod is to roll it at as high a tonnage rate as possible, to coil it either directly into a bundle (or onto a moving conveyor and thereafter to bundle it), to cool it to room temperature, either before or after bundling, to store it, and eventually to cold work or machine it as may be needed for the production of an end product. Except in the case of concrete reinforcing rod, and a few other minor applications, "as rolled" steel rod is not regarded as an end product in itself. Thus, in a large majority of cases the rod is cold-worked by wire drawing, cold heading and the like processes, and in some cases it is machined as well.

Due to the fact, that rod which is cooled in bundle form after rolling is highly non-uniform in its physical properties, the usual practice, with steels having medium to high carbon content, is to subject the rod to heat treatment by processes such as air or lead patenting, and sometimes by subcritical annealing to render the rod suitable for such cold working. When medium to high carbon content rod is cooled in open ring formation on a moving conveyor as by the process of U.S. Pat. No. 3,321,432, a much more uniform product is obtained which is suitable for cold drawing into various wire and spring steel products without the need for intervening heat treatment. The process of U.S. Pat. No. 3,321,432 has largely eliminated air patenting, but lead patenting is still practiced for certain special end uses. In addition, subcritical batch annealing is also employed in some cases for low carbon rods, and substantial tonnage of low carbon wire is process annealed.

One form of "flash" or short term, continuous annealing of rod of various carbon and alloy contents in open ring form on a moving conveyor is disclosed in U.S. Pat. No. 3,711,338. The latter process provides some increase in ductility through the start of spheroidization in the various ranges of steel grades disclosed, but it has not gone into general practice because it does not eliminate the need for annealing.

It is also desireable to provide additional treatments of rod other than simple annealing in order to obtain other properties more like those of tempered martensite, but hitherto no process has achieved such an objective.

It is, therefore, an object of this invention to provide a process and apparatus by which steel rod can be rolled and treated and rendered suitable for the specific cold working task intended without conventional heat treatment, as a substitute for a wide range of conventionally heat treated steel rod products. Another object is to provide a means for treating steel rod in direct sequence with rolling whereby physical properties equal to annealed rod, and approaching tempered martensite can be obtained.

Further objects include the provision of methods and apparatus for conserving the expenditure of heat during said processing, for controlling the "structural grain size" by heat treating, and controlling the surface conditioning thereof by cooling and/or coating the rod in sequence with rolling and cooling, whereby physical properties functionally equal to those of conventionally heat treated and or coated products can be obtained in substantially less time and with substantially less expenditure of energy than in conventional heat treating.

Still another object is to provide steel products which, although different in microstructure from conventionally heat treated products of the same composition, are capable of being substituted therefore, or even surpassing same, in the end use.

BRIEF DESCRIPTION OF THE INVENTION

In the accomplishment of these and other objects, in a preferred embodiment of the present invention, a billet of steel is first reduced to rod size by hot rolling. In modern practice, during this first stage, the rod issues from the final finishing stand of the rolling mill at very high speed (e.g. approaching 20,000 fpm). Next, the rod is coiled directly onto a moving conveyor in spread-out ring form. The rod can be water-cooled in an extended delivery pipe if desired. Once the rod is on the conveyor, it may be cooled either by air or water sprays to start the transformation of austenite. At this point the rod may either be further cooled to complete the transformation and conveyed to a collecting station as in U.S. Pat. No. 3,321,432, or diverted onto an intermediate conveyor and deposited in bundle form onto a pallet on which a mandrel or "spider" is mounted so as to hold the bundle in an upright position. The pallet is then conveyed into one or more chambers adapted for various forms of heat treatment, cooling, coating and/or baking.

The processes according to the present invention differ from conventional heat treating processes because, in each case, the starting point of the process is a hot rolled steel rod in which recrystallization of the austenite has just taken place at several hundred degrees above $A_3$, and in which grain growth (by the coalescence of smaller grains) is proceeding rapidly throughout the steel with high uniformity. This not only affects the process steps, but also the structure, with the result that the end products, although suitable for use in place of conventional products, are not actually the same, nor is the process for arriving at them the same.

Thus, in one of the processes of the present invention, the functional objective is to provide a medium or low carbon rod of very high ductility which is suitable for eliminating subcritical annealing either of the rod itself in some cases or in other cases of eliminating the need of annealing the wire during processing. The specific objective of the process in metallurgical terms is to increase the mean free path in the ferrite component of the microstructure between carbide clusters, as well as to provide as large as possible structural grains in the ferrite (not to be confused with austenite grain size). Accordingly, immediately after rolling, the rod is rapidly cooled to a temperature near to $A_3$ so as to preserve a small austenite grain size. Next the rod is laid onto a slowly moving conveyor and cooled through transformation by means of air. On the conveyor the rod rings are slightly spaced in staggered relation, but rapid coiling is to coil the rod without elevating the temperature above $A_1$, the rod is collected into a bundle on a mandrel mounted on a movable pallet and moved thereon into an annealing furnace in which the temperature of the rod is elevated to just below $A_1$ (i.e. about 677° C. (1250° F.)). Since the rod is cooled first in spread-out ring form in many places to about 600° C., it is relatively stiff and tends to hold its spread-out shape. Accordingly, when the rod is deposited onto the mandrel, it resists being brought together into the bundle form, and the result is a substantially open and progressively offset bundle which permits relatively rapid access of liquids and gases to all parts of the rod in the bundle. Thus, the bundle rapidly and substantially uniformly reaches the subcritical temperature, and the annealing process commences rapidly without loss of valuable energy. Since there is a maximum of free ferrite precipitation due to the relatively large surface area of the small austenite grains, and since the ferrite colonies are uniformly distributed, the coalescence of the ferrite colonies takes place rapidly and the structural grain size of the ferrite starts to increase uniformly. Likewise, due to the large number of neucleation cites resulting from the small austenite and the tendency toward coalescence due to the coarseness of the pearlite from slow cooling through transformation, the carbides in the pearlite commence coalescence similarly rapidly and uniformly. As the ferrite colonies coalesce, they tend to shift the points of carbide concentration into clusters where coalescence thereof is promoted. The important part of the coalescence of the ferrite colonies, however, is that they shift the carbide clusters into groups and thereby increase in the mean free path in the ferrite between both structural grain boundaries and carbide clusters. The holding time at the critical temperature depends upon the properties desired in the rod. It should be noted, however, that due to the relatively low standard deviation in size of the ferrite clusters, there is an extremely low incidence of places in the microstructure where the mean free path in the ferrite is relatively short. Thus, rupture during subsequent cold working in the rod of this process is less than with conventionally annealed rod even without full coalescence of the carbide clusters. Thus, holding times in order to achieve given functional objectives are less with this process, than with conventional annealing.

In another process according to the present invention, designed to provide a rod having properties more like those of tempered martensite, a medium to high carbon content steel rod is laid onto the conveyor and cooled rapidly to start transformation in a multiplicity of places at a rate calculated to produce both martensite and bainite. This is done by spraying water on the rod immediately after it is laid on the conveyor. Thereafter, as the rod is starting transformation, it is deposited on the above-mentioned mandrel and pallet. Although the rod would soon become too stiff and brittle to compress into bundle form, there are still enough places in it where transformation is incomplete, to permit the rod to compress into a bundle without breaking. Additional water is then sprayed onto the bundle from all sides and in the center to completely cool it. Thereafter, it is conveyed into the annealing furnace, where its temperature is brought up to the desired tempering temperature, i.e. 150° C. to 500° C. and held for long enough to achieve the desired tempering, a wide range of properties being feasible. The resulting rod contains significant amounts of tempered martensite. Due to the smallness of the prior austenite grains, and their high uniformity, there are a great many more neucleation sites for the start of precipitation of carbide from the alpha-iron solid solution (martensite) than in the usual case of tempering martensite, and, for this reason the tempering of the martensite proceeds more rapidly and more uniformly than in martempering. The result is a product of high strength and ductility.

In still another process coming within the broad confines of the present invention, the object is to produce a rod having properties in some ways similar to an austempered product. The rod is cooled rapidly by the application of water thereto in the delivery pipes, to about 550° C. It is then cooled and deposited in a relatively matted condition on a slowly moving conveyor and further cooled to about 500° C. (i.e. lower bainite range) while transformation starts in many places in the rod. Next, the rod is deposited in bundle form on the above-described mandrel and pallet, and moved into the annealing furnace where the rod temperature is maintained in the lower bainite range for 15–20 minutes. The result is a product containing substantial amounts of bainite and some tempered martensite. Also, due to the fact that the process starts with small and uniform austenite grains, the precipitation of free ferrite is not totally suppressed, and therefore the structure differs from conventional austempered products in that it contains more free ferrite, and larger free ferrite colonies, all other things being equal.

In another process coming within the broad confines of the invention, rod is rolled, then cooled rapidly on the conveyor by the use of water sprays, and then deposited onto the above-mentioned mandrel and pallet. Next a coating is applied to the rod after which the rod is annealed or baked as required for the given end use. In this way the surface of the rod may be protected and its treatment controlled during the annealing stage. The open, offset nature of the bundle on the pallet make this type of coating and baking treatment feasible.

The apparatus of the invention comprises the combination of the rolling mill and a rod cooling and collecting section comprising a delivery pipe for guiding the rod from the mill to a ring laying head, water-cooling is provided optionally in the delivery pipe. The laying head, which may be horizontal or at an angle thereto, is arranged to deposit the rod in ring form onto a moving conveyor having adjustable speed. Means are provided for cooling the rod on the conveyor comprising water spray nozzles and air nozzles. The conveyor is equipped to convey the rod either directly to a final collecting and bundling station, or to divert the rod at an intermediate point to one or more side conveyors where the rod is deposited onto a mandrel mounted on a movable pallet which is carried on a pallet conveyor. The pallet is arranged to permit further treatment of the rod either to cool it by water sprays or forced air, or to coat it or to heat treat or bake it.

The apparatus is arranged to provide parallel lines within the heat treating furnace so that a large number of bundles can be in process simultaneously. The option of delivering the rod directly to a final collecting station, however, permits the mill operator to schedule different kinds of steel for processing and in case an unusually long annealing cycle is desired, the annealing furnace can be loaded at one time and production can thereafter be continued on a steel rod for which holding in the annealing furnace is not desired.

DETAILED DESCRIPTION OF ILLUSTRATIVE EMBODIMENTS

Figure 1:
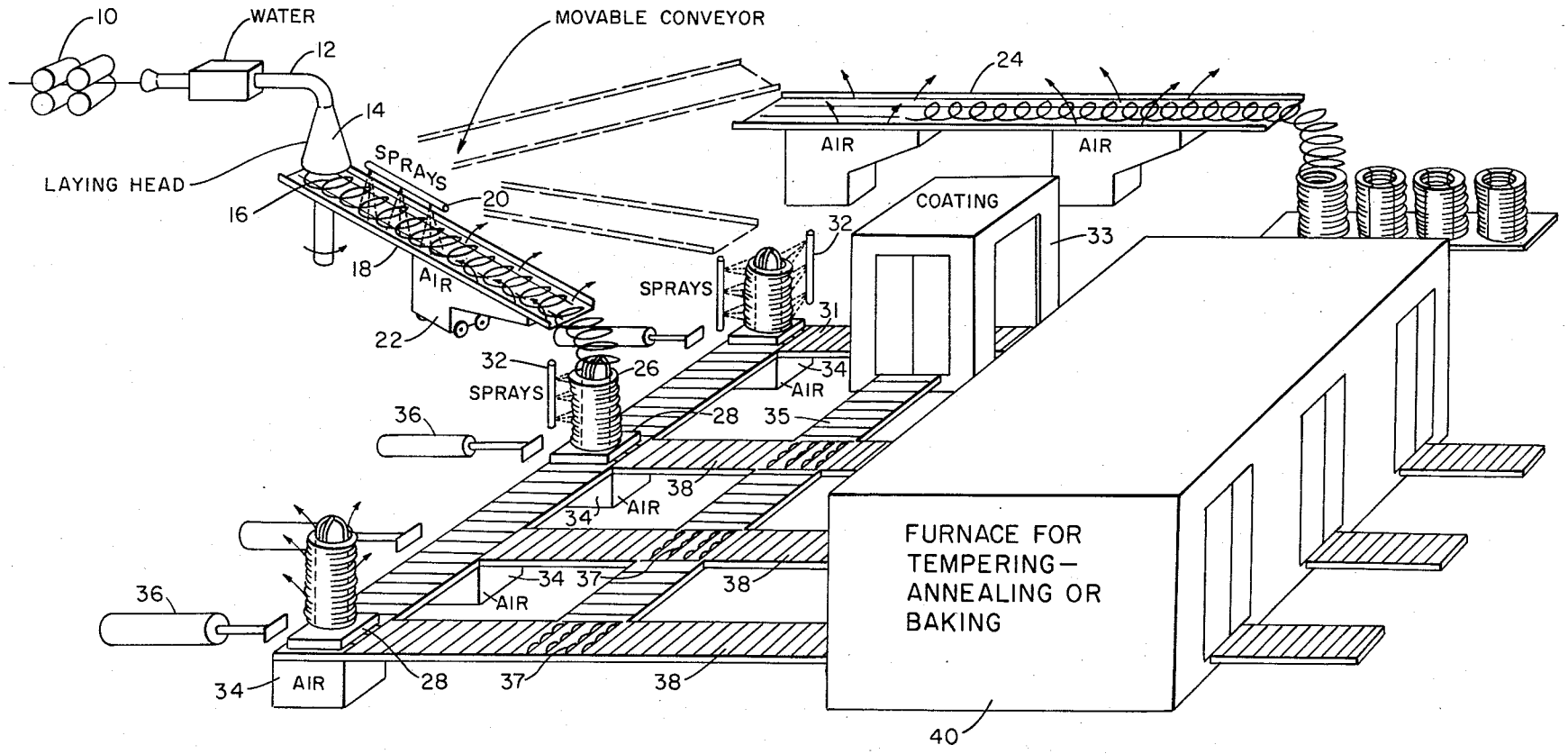
FIG. 1 is a diagrammatic view in isometric perspective showing the general arrangement of the combined components of the apparatus.

The apparatus of the present invention consists in a combination of components shown diagrammatically in FIG. 1. The basic component is the rod rolling mill, of which only the final finishing rolls 10 are shown. The mill is, of course, a standard component and its configuration is of no consequence to the invention. Therefore, it need not be shown in detail. However, in the sequence of process steps and in the combination of the apparatus the hot rolling feature is critical and forms a part of the inventive combination.

When the rod issues from the final finishing rolls 10 it then passes into a delivery pipe 12 which guides it to a laying head 14 which coils the rod into rings 16 and deposits them onto a moving conveyor 18, driven by chains and motors not shown. The conveyor 18 conveys the rings 16 away from the laying head 14 in offset relation. The speed of the conveyor 18 may be varied as desired from 25 to 150 fpm. Conveyor 18 supports the rod only at spaced points and is sufficiently open to permit the passage therethrough of fluid coolants. A series of water sprays 20 is provided adjacent to the conveyor 18 for applying water to the rings for rapid cooling as required. In addition a fan, manifold and air-nozzle combination 22 is provided to apply a cooling air blast to the rings as required.

The apparatus is equipped alternatively to move the rings onto a second conveyor 24 where they are conveyed directly to a collecting and bundling station as in U.S. Pat. No. 3,321,432, or by swinging conveyor 18 at an angle to the side, to deposit the rings onto a mandrel 26 mounted on a movable pallet 28 which is transported on a roller conveyor 30.

A second series of water sprays 32 is provided alongside conveyor 30 to spray water onto the rod both while it is being coiled and afterward as required. In addition a blower and manifold combination 34 is provided for blowing air upwardly through conveyor 30 and pallet 28 to further air cool the rings as required.

Hydraulic rams 36 are provided to shove pallets 28 off of conveyor 30 onto annealing conveyors 38 which are arranged to carry the pallets 28 through an annealing or tempering furnace 40. The furnace 40 is of conventional design and can be any size depending upon the mill requirements. In addition it can be equipped with doors for sealing a batch of rod within the furnace area for extended treatment periods in a controlled atmosphere. Adjacent to the first deposit point on conveyor 30 a conveyor 31 is provided at right angles to conveyor 30 to convey the pallets into a coating chamber 33 in which coating material is sprayed onto and through the bundle and from which the pallets exit via conveyor 35. It is a feature of the invention that the relatively open and offset form of the bundle permits access of coating material to virtually all parts of the rod. Conveyor 35 effectively traverses conveyors 38 by means of retractable rollers 37, arranged to lift the pallets across conveyors 38 or when retracted to deposit the pallets onto the conveyors 38 so as to pass coated bundles through the furnace for baking and/or annealing.

One of the basic features of the apparatus is the versatility it provides, permitting a wide variety of treatment options. In addition a specific feature is the provision of a means for controlled cooling in ring form prior to annealing followed by coiling of the rod and thereafter by long term, subcritical annealing while the rod is coiled in a relatively open and somewhat offset bundle.

Figure 2:
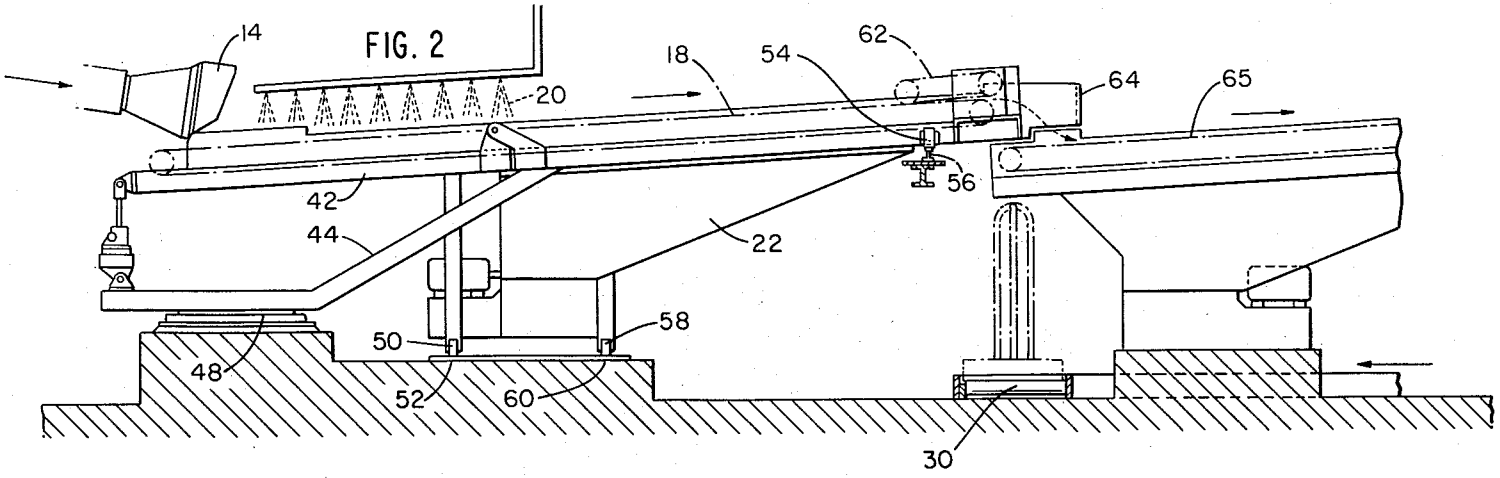
FIG. 2 is a view in side elevation of one embodiment of the initial conveyor portion of the invention in alignment with a conventional conveyor for conveying the rod to a collecting and bundling station.

Turning more specifically to the apparatus for conveying the rod rings 16 away from the laying head 14 in one of two directions, in FIG. 2, laying head 14 is shown disposed in a nearly horizontal position for depositing rod rings (not shown) onto conveyor 18. Conveyor 18 is supported on a longitudinally extending base 42 which is in turn supported by frame 44, mounted on a support bearing 48 for rotation in a horizontal plane. Base 42 and frame 44 are supported laterally by posts 46 (one only shown) mounted on rollers 50 (one only shown) on track 52 so that the conveyor 18 can swing about the axis of bearing 48. The far end of conveyor base 42 is provided with rollers 54 (one only shown) riding on track 56 to support the far end during the swinging motion of the conveyor 18.

Water cooling sprays 20 are provided over conveyor 18 arranged to spray water onto rings 16 after they exit from laying head 14. Conveyor 18 is a relatively open framework arranged to support the rod on spaced bars and to move the rod along the conveyor by means of driven chains on which upstanding lugs (not shown) are mounted to contact the rod. The cooling water, therefore, is free to pass through the conveyor. If desired, however, the spaces between the chains can be enclosed so as to deter the water flow and provide a virtual immersion of the rod rings in the water.

An air fan and manifold combination 22 is also provided in association with conveyor 18, arranged to project a blast of cooling air upwardly through the rod rings. The fan and manifold 22 are connected to conveyor base 42, but is also provided underneath with support rollers 58 riding on track 60.

At the end of conveyor 18, an overhead "tractor chain" 62 is provided to hold the rings horizontally as they come to the end of the conveyor and enter a collecting tub 64 through which they drop onto a second conveyor 65 when it is desired to convey the rings directly to a collecting and bundling station. Conveyor 65 may also be provided with air and/or water cooling in the same manner as conveyor 18.

Figure 3:
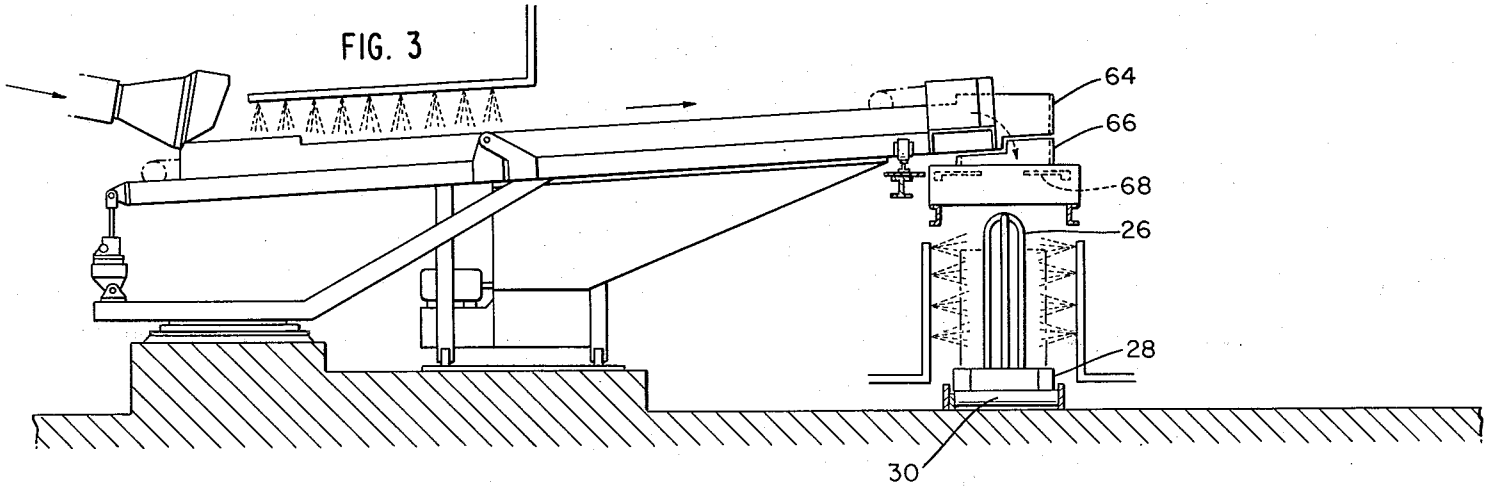
FIG. 3 is a view in side elevation of the apparatus of FIG. 2 in alignment with a pallet conveyor.
Figure 4:
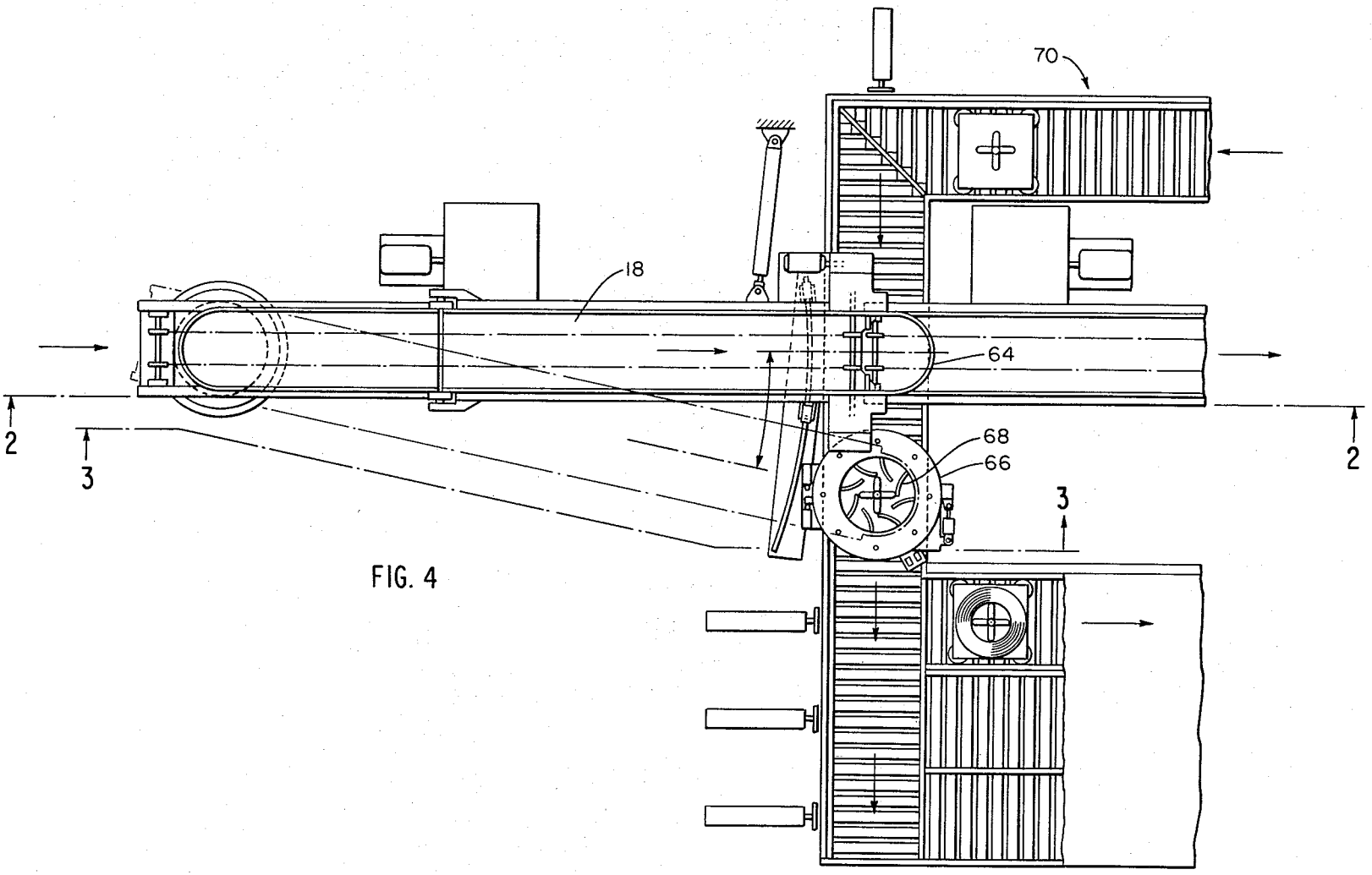
FIG. 4 is a plan view of the embodiment of FIGS. 2 and 3.

When it is desired to divert the rod rings in order to perform batch type operations, conveyor 18 is pivoted to the right (see FIGS. 3 and 4), to position tub 64 over a collecting cylinder 66 for guiding the descending rings onto mandrel 26 mounted on movable pallet 28 on conveyor 30.

Cylinder 66 is provided with temporary arresting arms 68 onto which rod rings from the next succeeding billet may be collected while a previously filled pallet is being moved away and an empty pallet is being put into position to receive rings.

The pallets 28 and mandrels 26, are fabricated of heavy gauge heat resistant steel, suitable for withstanding the severe abuse involved in holding the rod rings and in their heat treatment. Empty pallets may be brought into position by means of a return conveyor arrangement indicated at 70 in FIG. 4.

Figure 5:
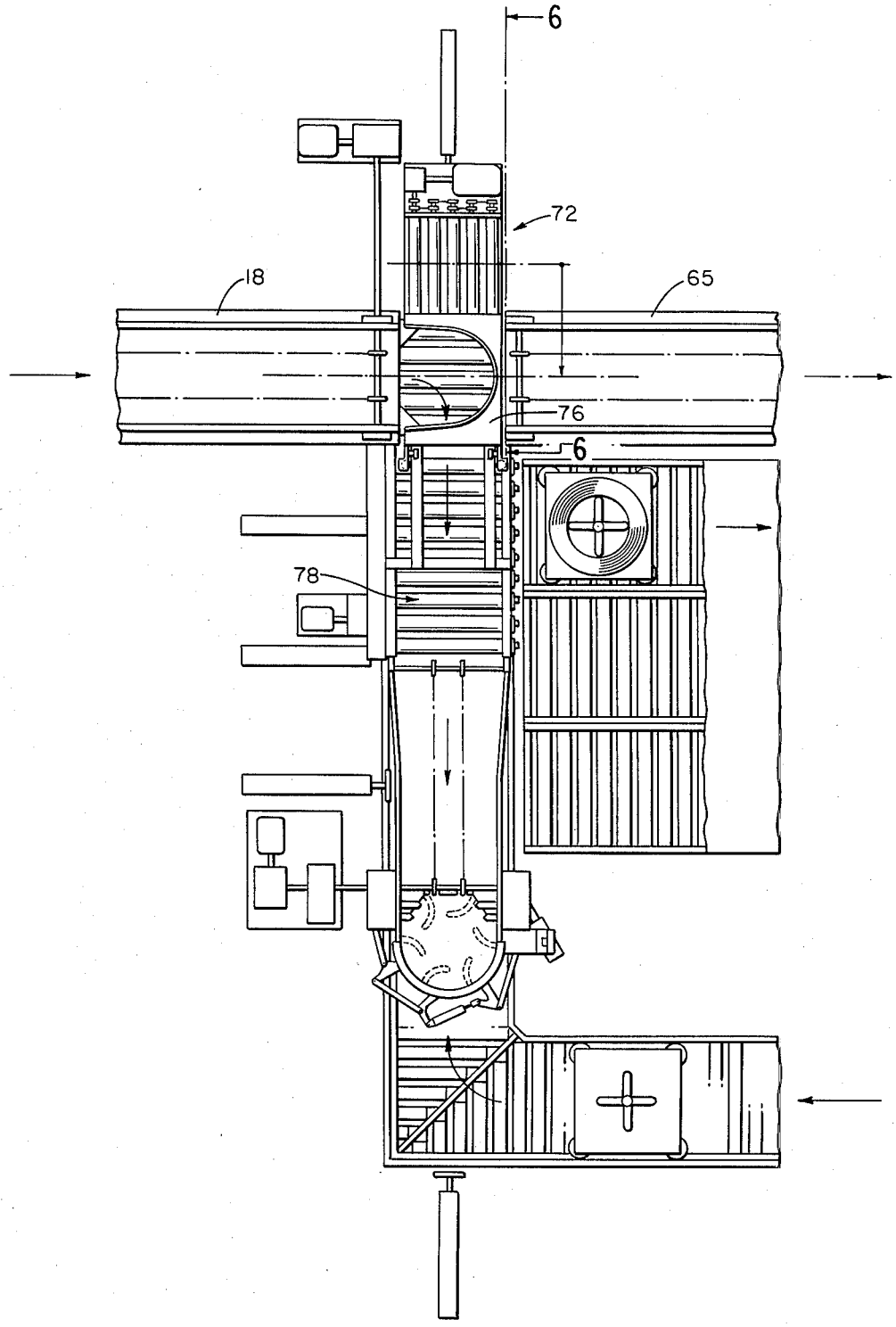
FIG. 5 is a plan view of a second embodiment showing the use of a short, removable conveyor for directing the rod to an annealling furnace.
Figure 6:
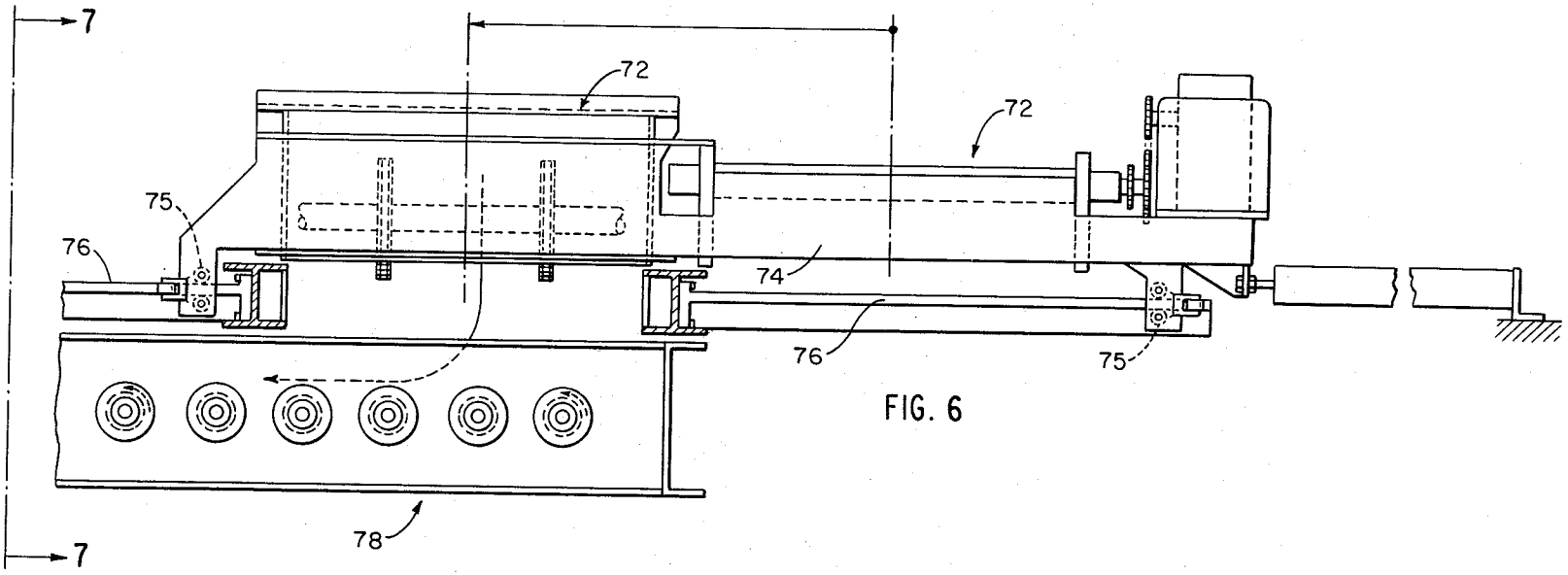
FIG. 6 is a view in end elevation taken along the lines of 6—6 of FIG. 5.
Figure 7:
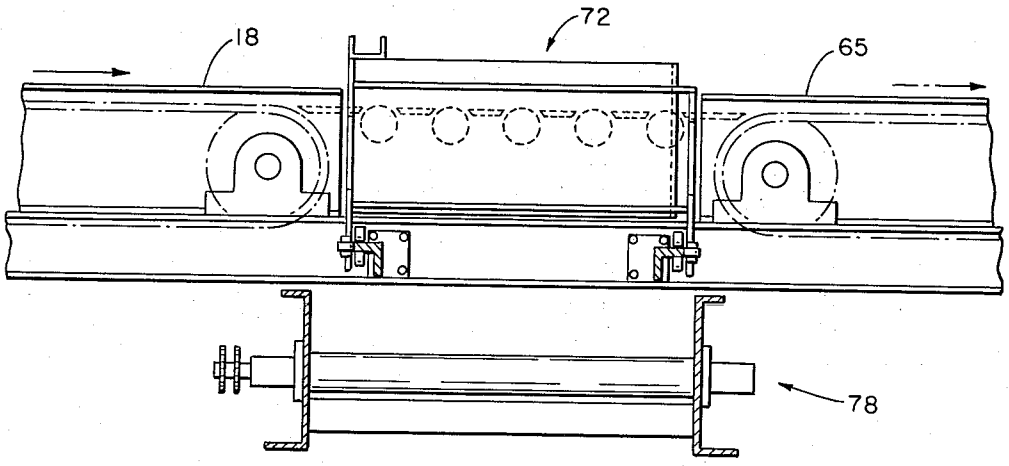
FIG. 7 is a view in side elevation taken along the lines 7—7 of FIG. 5.

A second embodiment of the apparatus for diverting the rod rings from conveyor 18 to conveyor 30, is shown in FIGS. 5, 6, and 7, in which a short retractable section of roller conveyor indicated at 72 is interposed between conveyor 18, and conveyor 65. Conveyor 72 is mounted on a frame 74 to slide on rollers 75 on tracks 76 from a retracted position as shown in FIGS. 5 and 6, to an operative position as shown in dotted lines in FIG. 7. At the opposite end of frame 74, a guide cylinder 76 is mounted on frame 74 in position to guide rod rings coming from conveyor 18 in a downward path onto an intermediate conveyor indicated at 78 which conveys the rings laterally to a collecting cylinder 80 which is virtually the same in construction and mode of operation as cylinder 66 previously described. As the rod drops through cylinder 80, it is formed into a relatively open and offset bundle on mandrels 26 mounted on pallets 28 and treated as previously described.

Figure 8:
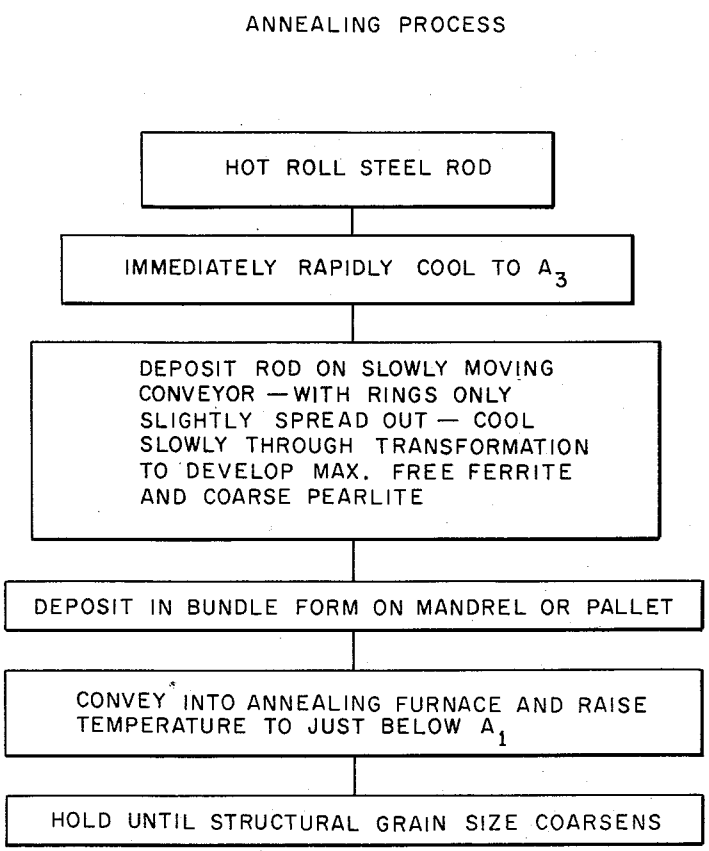
FIG. 8 is a flow diagram illustrating the process designated as Process "A" which provides a product having properties similar to those produced by subcritical annealing.

The various process options included within the broad scope of the invention are illustrated in the flow diagram of FIGS. 8–11, as follows:

(1) Process "A" (FIG. 8)

Process "A" is intended to provide a product similar to that of a subcritical annealed product. Many different compositions of steel may be used ranging from low carbon plain steel to high carbon alloy steels. The steps are as follows:

(a) Hot roll the rod in the conventional manner, (b) As the rod exits from the final finishing stand of the mill with its austenite grains in the freshly recrystallized state and rapidly growing by merger of smaller grains under conditions of substantial excess heat above $A_3$, cooling the rod rapidly to about or slightly below $A_3$ by the application of water thereto. Preferably the cooling should be done in the delivery pipes and in stages adjusted to avoid chill-hardening the rod surface. Additional water sprays may be applied after the rod has been coiled, but the rapid cooling should be terminated close enough to $A_3$ to avoid any substantial transformation under rapid cooling conditions.

(c)The rod is now coiled into rings and deposited onto a slowly moving conveyor so that the offset of the rings is between about 2 mm to 10 mm. In this way transformation is retarded and a maximum precipitation of the ferrite as well as a maximum development of coarse pearlite are obtained. In conventional cooling cycles both of these constituents are considered undesirable, but in the present process they are specifically desired because of their subsequent contribution to the effectiveness of the further treatment. While on the conveyor a major part of the rod is cooled to about 600° C. and transformation takes place to a substantial degree.

(d) Next the rod is formed into a bundle and deposited onto a mandrel mounted on a movable pallet. During this step the temperature of the remainder of the rod is reduced to around 600° C. and transformation is completed.

(e) Next the pallet is moved into an annealing furnace where the rod temperature is brought up to just below $A_1$ (usually around 667° C.). During this step the offset nature of the bundle is a distinct advantage because it permits a rapid penetration of the annealing temperature to all parts of the rod.

(f) The rod is now held at the subcritical temperature while the structural grain size coarsens and the carbides of the coarse pearlite start to form clusters. Varying degrees of ductility can be obtained at this stage, and the process can be terminated when the desired ductility has been reached.

Several aspects of this embodiment should be noted. Thus, the smallness and uniform distribution of the austenite grains resulting from steps (a) and (b) above contribute materially to the homogeneity of the steel composition. This is important because the same homogeneity is retained through the subsequent steps and it provides a steel in which there is a small maximum deviation of physical properties within the steel. This means that the weakest places in the steel at which rupture will start are stronger than in conventional steels in which the maximum deviation of properties is greater.

In addition, the smallness and uniformity of the austenite contributes importantly to the precipitation of a maximum amount of free ferrite in step (c). The small austenite grains have a relatively large surface area at which the precipitation takes place. As a consequence, while the steel is being held at a temperature at or near to $A_3$, the steel completely separates into ferrite and virtually pure eutectic steel. As the temperature of the rod gradually descends thereafter, preferably at about 4°/sec., the eutectic portion further segregates in to the usual pearlite lamina of cementite (carbide) and ferrite which are formed gradually under conditions which permit maximum concentration of the cementite into coarse pearlite. In this condition the steel is relatively soft and has poor ductility as well.

After the steel temperature has been brought back up near to but below $A_1$, however, the normally undesireable conditions serve an important purpose. The uniform distribution of the free ferrite, and the coarse pearlite ensures equally uniform respective coalescence rates for the ferrite and the carbide. This effectively avoids the creation of non-uniformly sized clusters of either ingredient. In addition, the coarseness of the pearlite helps bring the carbides into proximity. Thus, as the ferrite clusters start to coalesce and the structural grain size thereof starts to grow, the boundaries between the ferrite clusteries merge and move. This in turn moves the carbide clusters which exist between the ferrite clusters, closer to each other, especially in medium to low carbon steels. The result is to increase the mean free path of relative motion within the ferrite. Thus during subsequent cold working, the harder carbide clusters have a longer path of relative motion in the ferrite before the limit of deformation is reached. A condition of good ductility is therefore reached in this embodiment of the process before full coalescence of the carbides (in the sense of forming spheroids) has been achieved. Due to this it is usually economically more advantageous to terminate the process at this stage rather than continuing it until full spheroidization has been reached.

Figure 9:
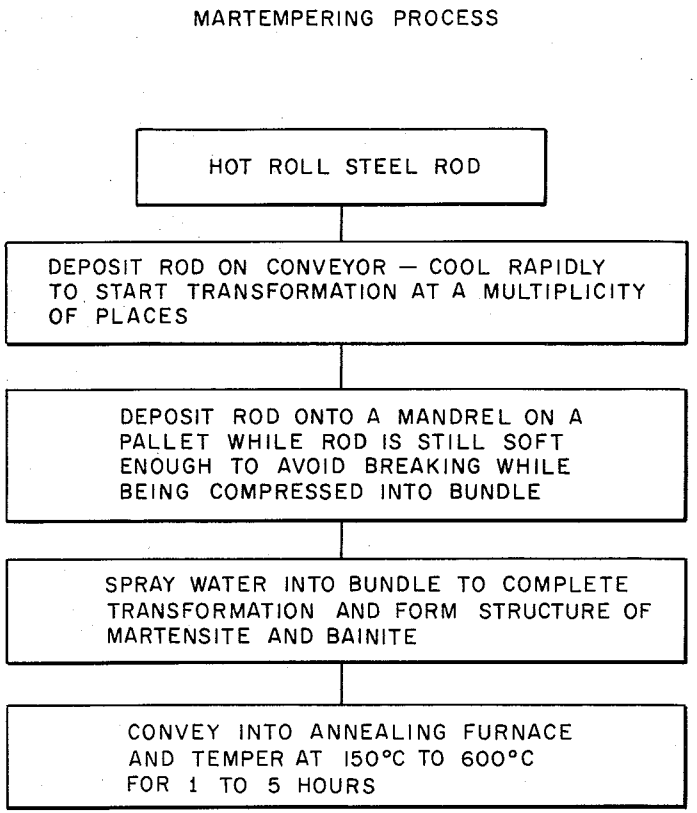
FIG. 9 is a flow diagram illustrating Process "B" which provides a product containing substantial amounts of tempered martensite.

(2) Process "B" (FIG. 9)

In Process "B" the objective is to produce substantial quantities of tempered martensite. As with Process "A", many different grades of steel may be employed. With some grades, however, the initial rigorous quenching step will cause such stress in the steel that shattering will occur. This is, of course, to be avoided, but short of causing such severe stressing of the steel, any grade capable of producing martensite may be used. The steps are as follows:

(a) Hot roll the rod in the conventional manner.

(b) Immediately after rolling the rod is deposited onto a moving conveyor at a temperature above $A_3$. It can be cooled in the delivery pipes to some degree. The conveyor speed is selected to provide enough spacing between the rings (i.e. over 2 cm) to permit ready access of a liquid coolant to a major part of the rod. While on the conveyor the rod is rapidly cooled by the application of water sprays. The cooling is done, at as fast a rate as possible without making the rod too hard to compress from the spread-out state on the conveyor into a generally cylindrical bundle. The water sprays, however, cannot cool the rod uniformly, and as a result some parts of the rod rapidly start transformation before other parts reach transformation.

(c) With the rod in the condition in which some parts have still not transformed, the rings are compressed longitudinally and dropped onto a mandrel mounted on a movable pallet.

(d) Next water is sprayed heavily onto the bundle to complete the water quench and thereby to form a maximum of martensite. As mentioned above, the relatively open, offset nature of the bundle is an advantage in this step because it permits the coolant to reach all parts of the rod.

(e) Next the rod is conveyed into a tempering furnace either directly after cooling, or by way of a coating station. The tempering time and temperature is selected according to the properties of tempered martensite desired. Normally it will be held for several hours at around 500° C.

Process "B" enjoys the same advantages of homogeneity and multiplicity of neucleation sites for coalescence discussed above in connection with Process "A". In addition, due to the smallness of the austenite, it is virtually impossible completely to suppress the precipitation of free ferrite, and as a result, a different microstructure is formed. Also the hardness and tendency toward stress cracking which are normally encountered in martempering do not appear to such a degree in this embodiment of the invention.

In addition, since the bundle on the pallet can be admitted directly to the tempering furnace without permitting the temperature to fall below 350° C., this is an important advantage particularly with certain low alloy steels, because such steels suffer a loss of ductility when tempered in the range of 210° C. to 315° C. With Process "B", the steel need not pass through this harmful cycle at any time until the desired tempering has been completed, and even then, for only a short time.

Figure 10:
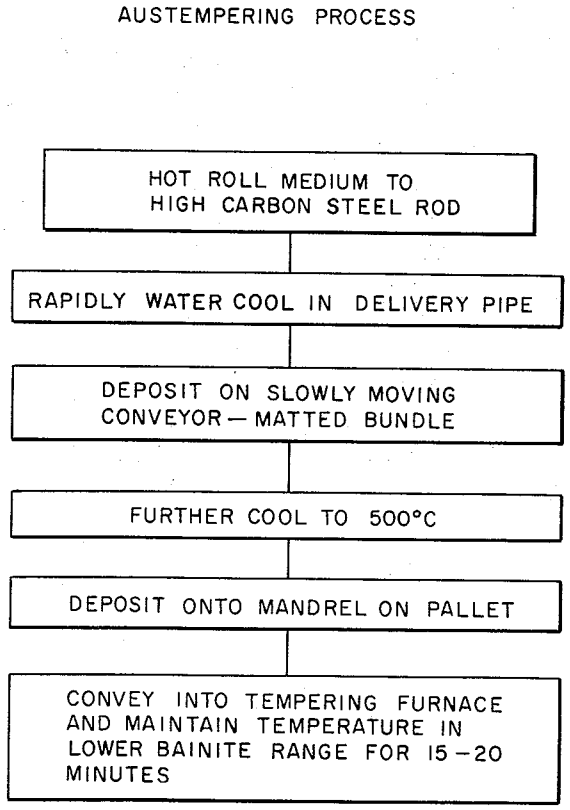
FIG. 10 is a flow diagram of Process "C" which provides a product containing substantial amounts of tempered bainite.

(3) Process "C" (FIG. 10)

In Process "C" the objective is to obtain substantial amounts of tempered bainite. As with processes "A" and "B", a wide range of steels may be employed. The steps are as follows:

(a) Hot roll the rod in the conventional manner.

(b) Rapidly cool the rod in the delivery pipe to as low a temperature as may be consistent with subsequent formation into rings in a conventional laying head.

(c) Deposit the rod in ring form onto a slowly moving conveyor so that the rod spacing is between about 2 mm and 10 mm.

(d) Spray water on the rod to cool it to about 500° C. average.

(e) Deposit rod onto a mandrel mounted on a movable pallet while the temperature is still at about 500° C. average.

(f) Convey the rod on the pallet into a tempering furnace where the temperature is maintained at about 500° C.

In this embodiment, the objective is to avoid the formation of excessive martensite and the stress problems created thereby. Therefore, step (d) is adjusted to promote a mixture of martensite and bainite. Here again, however, due to the very small austenite grains, free ferrite precipitation cannot be avoided and as a result a tougher and more ductile product is attained. The tempering step is usually shorter in duration in this embodiment than the tempering step in Process "B". The product is also more ductile for a given tempering time. As before, this embodiment profits from the smallness and homogeneity of the austenite grains in the same manner as in the annealing and martempering embodiments.

Figure 11:
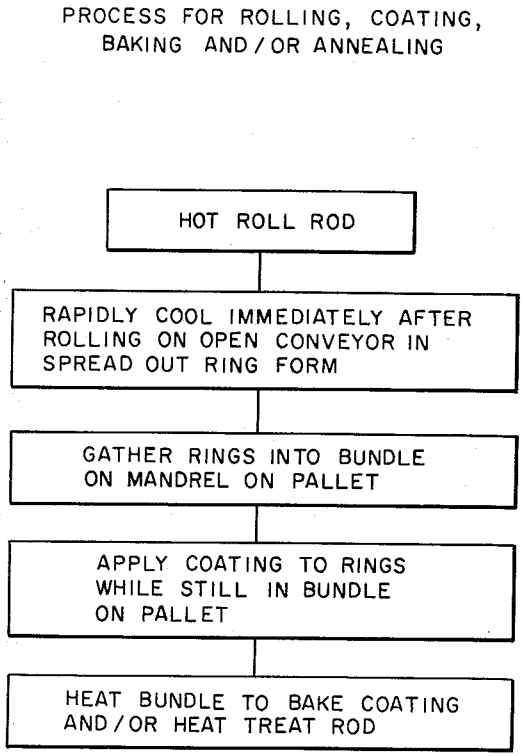
FIG. 11 is a flow diagram for the process steps for rolling, coating, baking and/or annealing according to the invention.

(4) Rolling, Coating, Baking and/or Annealing (FIG. 11)

In the rolling, coating, baking and/or annealing embodiment, there is no limitation as to the rod composition. The steps are as follows:

(a) Hot roll rod.

(b) Coil the rod and deposit it onto a moving open conveyor.

(c) Rapidly cool the rod immediately after rolling on the conveyor to a temperature at which the rod is relatively stiff.

(d) Gathering the rings into a bundle on a mandrel mounted on a pallet.

(e) Conveying the bundle to a coating station, and applying a coating to the rod, and (f) Thereafter baking and or heat treating the rod.

In this embodiment the rod product benefits from the grain size refinement of and homogeneity of hot rolling in a manner similar to the previously described embodiments. In addition the gathering of the relatively stiff rod rings from a spread out position into a bundle provides the open, somewhat offset bundle previously mentioned. This is important because it permits the coating materials to reach substantially all parts of the rod surface, and it also promotes the baking and/or heat treatment which follows.

In some cases step (f) will include both coating and heat treating.

One particular advantage of this embodiment is the rapid cooling from rolling temperature and the shortness of time between rolling and coating. In this way the formation of scale is kept so low that in some cases cold can be performed without any descaling. Substantial economies are also achieved by the elimination of handling steps, and the conservation of metal by the reduction of oxidation.

In general all embodiments of the invention enjoy the advantages of the sequence of rolling the rod, coiling it in spread out rings onto an open conveyor, gathering the rings into a bundle on a movable pallet, and subsequently treating the rod in the bundle. The form of the bundle obtained permits free access of treating materials to the rod, handling steps are avoided, and heat is conserved by making it possible to perform various batch type heat treatments in direct sequence with rolling without entirely losing the heat energy employed in rolling.

The apparatus is arranged for convenient switching from conventional rod rolling and cooling to treating the rod in bundle form. This makes it possible for the rod roller to perform in-line long term treatments such as annealing on the rod product of specific billets in direct sequence with rolling, while being able to switch back to conventional treatment without the need of any substantial down time in the mill. While emphasis has been placed on the treatment of steel rod in the processes described above, it will be seen that the rolling mill method of scheduling the rod product of given billets for batch type (bundle) treatments (heat treatments or otherwise) in direct sequence with rolling (without loss of sensible heat), while scheduling the rod product of other billets for continuous treatment in spread-out ring form and switching from one to the other without loss of production time is a highly advantageous feature of the invention applicable to other metals and is claimed to be inventive per se. Likewise the apparatus for so doing is equally advantageous and is claimed inventive per se as well.

We claim:

1. A process comprising the steps of
(a) hot rolling low to medium carbon content steel rod in the conventional manner;
(b) as the rod exits from the final finishing stand of the mill with its austenite grains in the freshly recrystallized state and rapidly growing by merger of smaller grains under conditions of substantial excess heat above $A_3$, cooling the rod rapidly to about or slightly below $A_3$;
(c) terminating the rapid cooling close enough to $A_3$ to avoid any substantial transformation of the steel under rapid cooling conditions;
(d) coiling the rod into rings and depositing them onto a slowly moving conveyor so that the offset of the rings is between about 2 mm to 10 mm, and retarding the cooling thereof to obtain a maximum precipitation of free ferrite as well as a maximum development of coarse pearlite;
(e) continuing the retarded cooling until a major part of the rod is cooled to about 600° C. and transformation takes place to a substantial degree;
(f) gathering the rings and depositing them onto a mandrel mounted on a movable pallet while reducing the temperature of the remainder of the rod to around 600° C. to complete transformation;
(g) placing the rod (on the pallet) in an annealing furnace and bringing the rod temperature up to just below $A_1$ (usually around 667° C.); and
(h) holding the rod at the subcritical temperature until the structural grain size coarsens, and the carbides of the coarse pearlite therein start to form clusters.

2. A process comprising the steps of:
(a) hot rolling steel rod;
(b) immediately after rolling depositing the rod in ring form onto a moving conveyor at a temperature above $A_3$, the conveyor speed being selected to provide enough spacing between the rings (i.e. over 2 cm) to permit ready access of a liquid coolant to a major part of the rod;
(c) while on the conveyor, rapidly cooling the rings by the application of water thereto, and at as fast a rate as possible without making the rod too hard to compress the rings from the spread-out state on the conveyor into a generally cylindrical bundle;
(d) with the rod in the condition in which some parts have still not transformed, compressing the rings longitudinally and dropping them from the conveyor onto a mandrel mounted on a movable pallet;
(e) spraying water onto a bundle to complete the water quench and thereby to form a maximum of martensite; and
(f) conveying the bundle into a tempering furnace and holding the rod at a predetermined tempering temperature for a predetermined period.

3. A process comprising the steps of:
(a) hot rolling steel rod in the conventional manner;
(b) rapidly cooling the rod by the application of water in a delivery pipe to as low a temperature as may be consistent with subsequent formation into rings in a conventional laying head;
(c) depositing the rod in ring form onto a slowly moving conveyor so that the rod spacing is between about 2 mm and 10 mm;
(d) spraying water on the rod to cool it to about an average temperature of 500° C.;
(e) depositing the rod onto a mandrel mounted on a movable pallet while the temperature is still at about 500° C., average; and
(f) conveying the rod on the pallet into a tempering furnace where the temperature is maintained at about 500° C., and holding the rod there for 15–25 minutes.

4. A process comprising the steps of:
(a) hot rolling metal rod;
(b) coiling the rod and depositing it onto a moving open conveyor;
(c) rapidly cooling the rod directly after rolling, on the conveyor to a temperature at which the rod is relatively stiff;
(d) gathering the rings into a bundle on a mandrel mounted on a pallet;
(e) conveying the bundle to a coating station, and applying a coating to the rod; and
(f) thereafter baking and/or heat treating the rod.

* * * * *